US007712405B2

(12) United States Patent
Toycen et al.

(10) Patent No.: US 7,712,405 B2
(45) Date of Patent: May 11, 2010

(54) VARIABLE CONTAINMENT VESSEL

(76) Inventors: Jeffrey E Toycen, 1723 Heron Road., Ottawa, Ontario (CA) K1V 6A2; Robert L. Musgrove, 32926 3rd Avenue, Mission, British Columbia (CA) V2V 1N3

( * ) Notice: Subject to any disclaimer, the term of this patent is extended or adjusted under 35 U.S.C. 154(b) by 490 days.

(21) Appl. No.: 11/415,066

(22) Filed: May 2, 2006

(65) Prior Publication Data

US 2007/0039453 A1 Feb. 22, 2007

Related U.S. Application Data

(60) Provisional application No. 60/676,308, filed on May 2, 2005.

(51) Int. Cl.
*F42B 33/00* (2006.01)

(52) U.S. Cl. ..... 86/50

(58) Field of Classification Search ..... 86/50, 86/1.1; 280/728.1, 728.2, 728.3; 102/331; 340/540; 89/36.02, 36.04, 36.17; 220/1.5, 220/1.6, 62.19, 88.1, 560.06, 560.08, 592.23, 220/720–723, 890, 900, 905; 109/3, 26, 109/27, 49.5, 58, 64; 244/29, 31, 33; 37/182, 37/461, 466

See application file for complete search history.

(56) References Cited

U.S. PATENT DOCUMENTS 3,080,138 A * 3/1963 Church ..... 244/31
3,103,326 A * 9/1963 Church ..... 244/31
3,220,671 A * 11/1965 Ashman et al. ..... 244/31
3,356,120 A * 12/1967 Nohmura ..... 86/50
3,580,603 A * 5/1971 Chute et al. ..... 280/743.1
3,820,479 A * 6/1974 Fylling ..... 86/50
4,150,503 A * 4/1979 Lespinasse ..... 37/309
4,390,199 A * 6/1983 Taylor ..... 292/346
4,543,872 A * 10/1985 Graham et al. ..... 86/50
4,621,562 A * 11/1986 Carr et al. ..... 86/50
5,104,060 A * 4/1992 Brotz ..... 244/31
5,249,534 A * 10/1993 Sacks ..... 86/50
5,335,689 A * 8/1994 Reittu ..... 244/31
5,864,767 A * 1/1999 Drumgoole et al. ..... 86/50
5,915,449 A * 6/1999 Schwartz ..... 160/330
5,988,675 A * 11/1999 Bathon et al. ..... 280/732
6,019,237 A * 2/2000 Durham et al. ..... 220/1.6
6,173,662 B1 * 1/2001 Donovan ..... 86/50
6,250,669 B1 * 6/2001 Ohmiya ..... 280/732
6,279,449 B1 * 8/2001 Ladika et al. ..... 89/36.17
6,425,934 B1 * 7/2002 Aoki et al. ..... 86/50
6,938,533 B2 * 9/2005 Holland et al. ..... 86/50
7,023,339 B2 * 4/2006 Stomski ..... 340/540
7,036,719 B1 * 5/2006 Helphrey et al. ..... 232/47
7,159,503 B1 * 1/2007 Weatherwax ..... 86/50
7,185,778 B1 * 3/2007 Palley et al. ..... 220/1.5
2003/0106414 A1 * 6/2003 Wang ..... 86/50
2004/0107823 A1 * 6/2004 Kiley et al. ..... 86/50
2005/0266748 A1 * 12/2005 Wagner et al. ..... 442/59

* cited by examiner

*Primary Examiner*—Michael Carone
*Assistant Examiner*—Jonathan C Weber
(74) *Attorney, Agent, or Firm*—Teitelbaum & MacLean; Neil Teitelbaum; Doug MacLean

(57) ABSTRACT

An explosion containment vessel includes an inner frame structure for surrounding a potential explosive device, and an outer expandable containment vessel, which expands with the explosion, thereby mitigating potential damage that a bomb blast could do. In addition, a bomb capturing device is provided on the bottom end of the inner frame for lifting the explosive device into the inner frame and for closing the bottom end of the inner frame.

12 Claims, 14 Drawing Sheets

VARIABLE CONTAINMENT VESSEL

CROSS-REFERENCE TO RELATED APPLICATIONS

The present invention claims priority from U.S. Patent Application No. 60/676,308 filed May 2, 2005, which is incorporated herein by reference.

TECHNICAL FIELD

The present invention relates to an explosion containment device, and in particular to a Variable Containment Vessel (VCV) or Bomb Bag for capturing a potential explosive device, and managing any explosion resulting therefrom.

BACKGROUND OF THE INVENTION

A conventional Explosives Ordnance Disposal (EOD) scenario includes the following steps:

1) Emergency services, e.g. 911, police or fire, receive a report, usually from a witness, regarding a suspicious looking package;

2) A team of EOD bomb technicians (or Fire personnel) is dispatched to the scene;

3) Upon arriving at the location of the suspected threat the witness will be interviewed and then the EOD technicians will: a) survey the situation, b) secure the area, and c) start making precautionary judgments about immediate risks to life and property. Concurrent with the precautionary measures being taken, other risk assessments are being developed as the EOD team determines, as best they can, the exact nature of the threat so that a successful render safe procedure (RSP) can be executed;

4) Typically, in the RSP procedure, if the package is small and looks harmless, it will be X-rayed in position to determine the contents or shot with a disruptor;

5) Alternatively, or in addition, in cases in which a more serious threat is perceived, the EOD technicians deploy a robot to transfer the package to a large containment vessel; and 6) In the instance where step 5) is not possible, e.g. on a cruise ship, aircraft or transit way, measures must be immediately taken to deal with the threat and to manage or defeat the potentially hazardous event.

The problem with steps 4) and 5) is that the package remains a threat to the public, private property and the EOD team during and after these steps. Moreover, robots may not have full access to the package, and the containment vessel may have to be positioned a great distance away, due to its size.

In order to simplify the RSP, i.e. to provide a simple first step that is justified for both low and high-risk situations, an easily deployable, relatively-inexpensive explosive-containment device is required. Several explosive containment devices have been proposed, such as those disclosed in U.S. Pat. No. 3,648,613 issued Mar. 14, 1972 to Arthur Cunn; U.S. Pat. No. 3,739,731 issued Jun. 19, 1973 to Patrick Tabor; U.S. Pat. No. 4,543,872 issued Oct. 1, 1985 to Graham et al; U.S. Pat. No. 4,836,079 issued Jun. 6, 1989 to Garth Barrett; and U.S. Pat. No. 5,044,252 issued Sep. 3, 1991 to Gamadi et al. Unfortunately, none provide an explosive containment system that provides safe containment for different sizes of explosions, i.e. the conventional devices are of a fixed size and shape, and will fail if the explosion is too powerful. Furthermore, most of the existing systems only cover the device, which does not prevent the explosion from damaging people or property below the device. While the Tabor device does disclose a tie string for raising the explosive device into the body of the containment device, it does not provide a remote capture system for completely enclosing the explosive device rapidly from a remote location, thereby eliminating any danger to the EOD technicians.

An object of the present invention is to overcome the shortcomings of the prior art by providing an easily deployable containment vessel, which can capture a potentially harmful device within an inner containment layer, and enclose any explosion within an outer expandable containment layer.

SUMMARY OF THE INVENTION

Accordingly, the present invention relates to a explosion containment device for enclosing an explosive device comprising:

a frame having a closed end, and an open end for receiving the explosive device;

an outer containment vessel mounted on the frame having an expandable volume;

whereby detonation of the explosive device causes the outer containment vessel to expand, thereby containing the explosion and preventing failure thereof.

Another aspect of the present invention relates to an explosion containment device for enclosing an explosive device comprising:

an inner containment vessel having a closed bottom end, and an open bottom end for placing over the explosive device; and a capture device for lifting the explosive device into the inner containment vessel and closing the bottom end of the inner containment vessel.

BRIEF DESCRIPTION OF THE DRAWINGS

The invention will be described in greater detail with reference to the accompanying drawings which represent preferred embodiments thereof, wherein.

DETAILED DESCRIPTION

A Variable Containment Vessel (VCV) is comprised of at least one of a series of modern day fabrics, e.g. Kevlar, Glass Fiber and Nomex, which are arranged into a containment vessel in such a way so as to accommodate rapid expansion into a larger shape for the purpose of containing a blast, either fragmentary or incendiary. Inner layers of the VCV are made of materials specifically designed to contain fragmentary and/or incendiary blasts. The product is intended to be easily deployed and to prevent damage to property, bystanders and EOD personnel.

Figure 1:
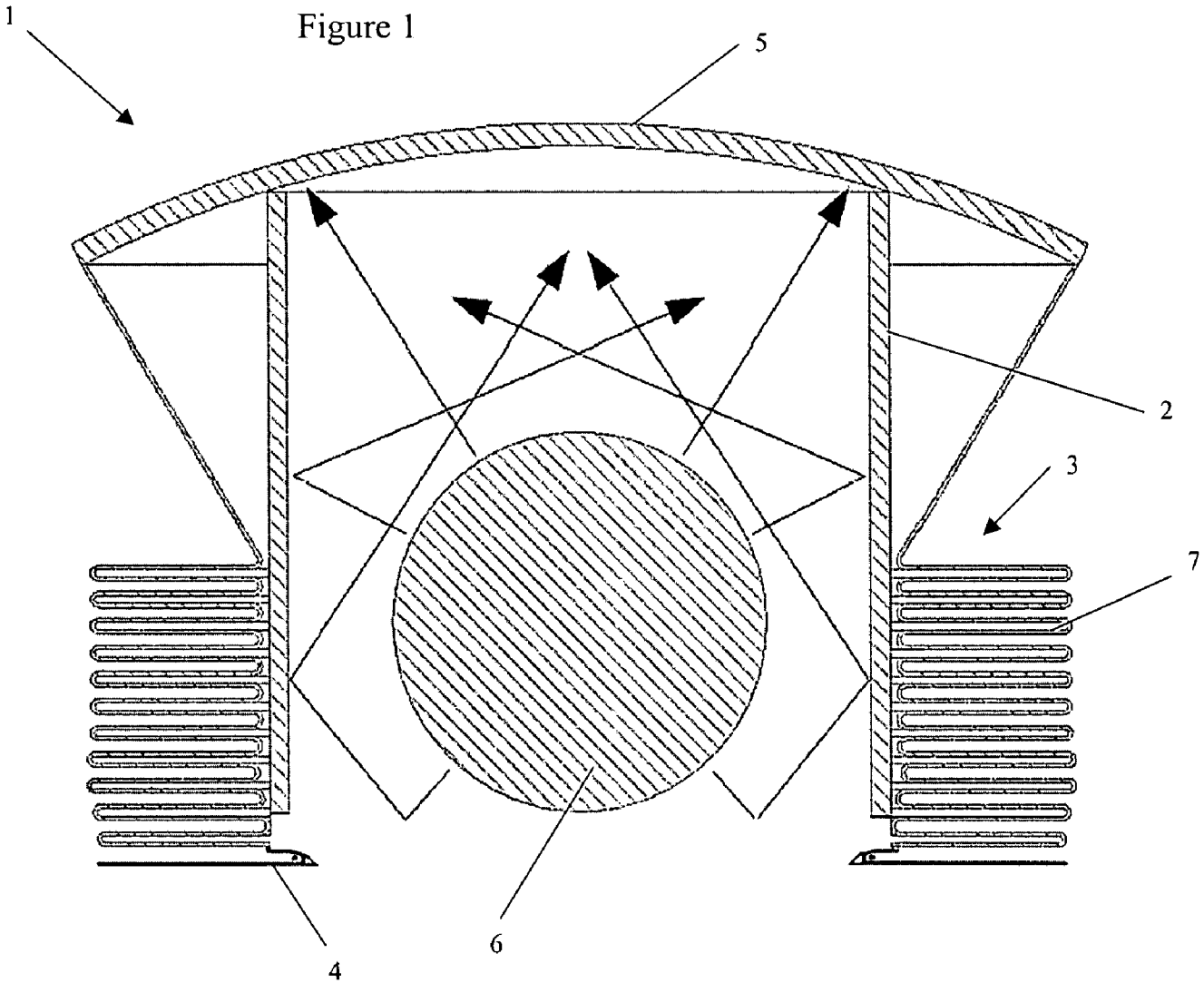
FIG. 1 is a cross-sectional view of a VCV according to an embodiment of the present invention in a retracted or storage position.
Figure 2:
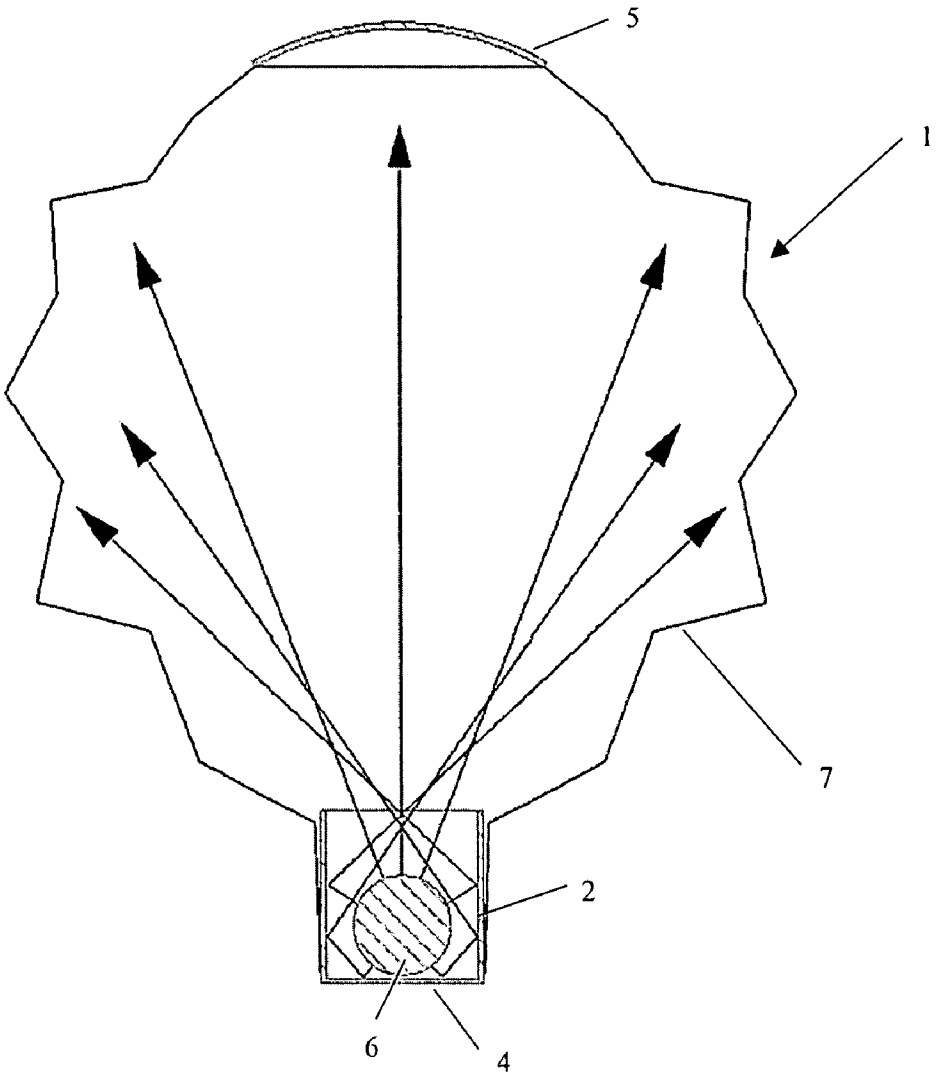
FIG. 2 is a cross-sectional view of the VCV of FIG. 1 in an expanded or deployed position.
Figure 3:
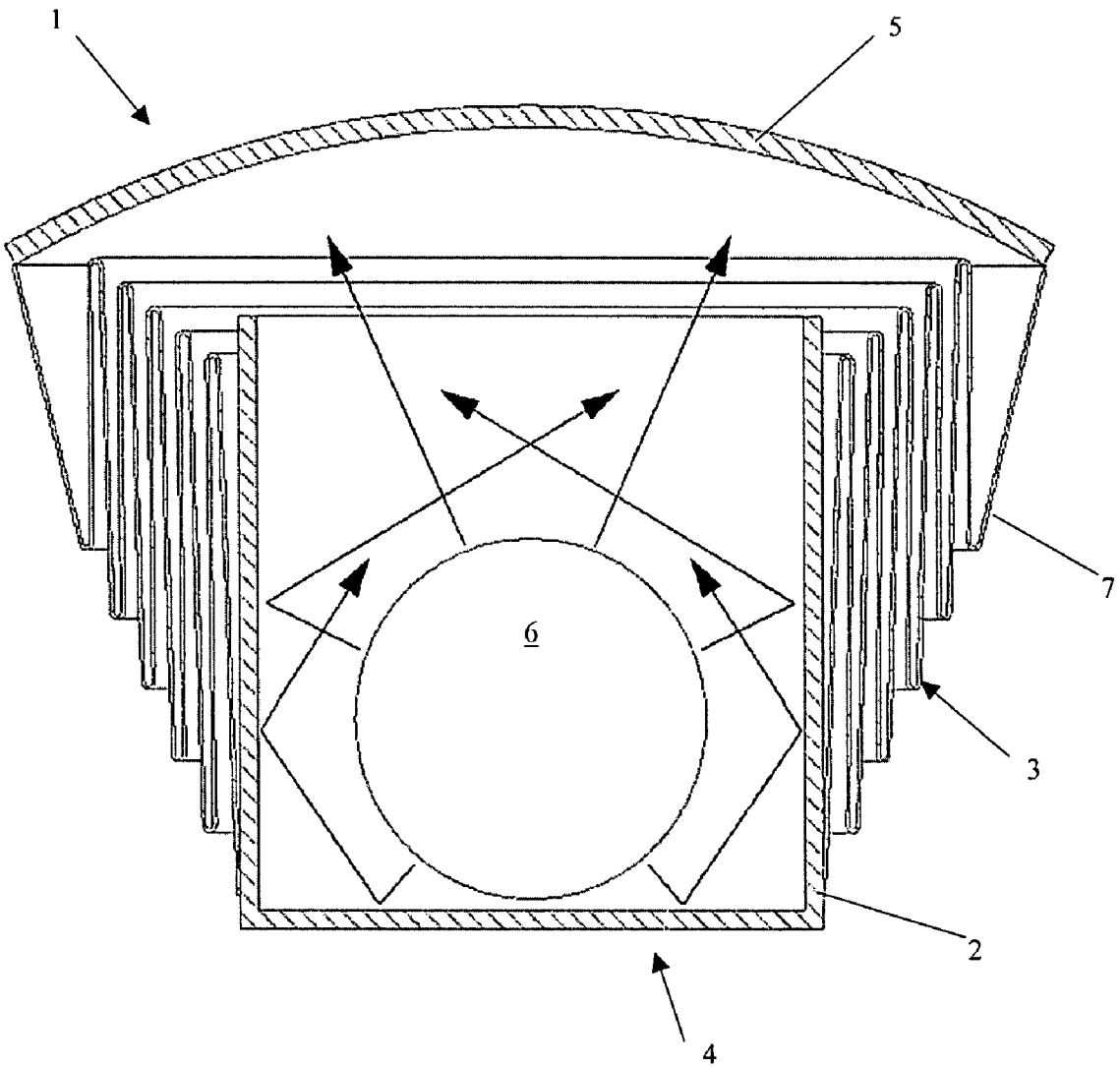
FIG. 3 is a cross-sectional view of a VCV according to another embodiment of the present invention in the retracted of storage position.
Figure 4:
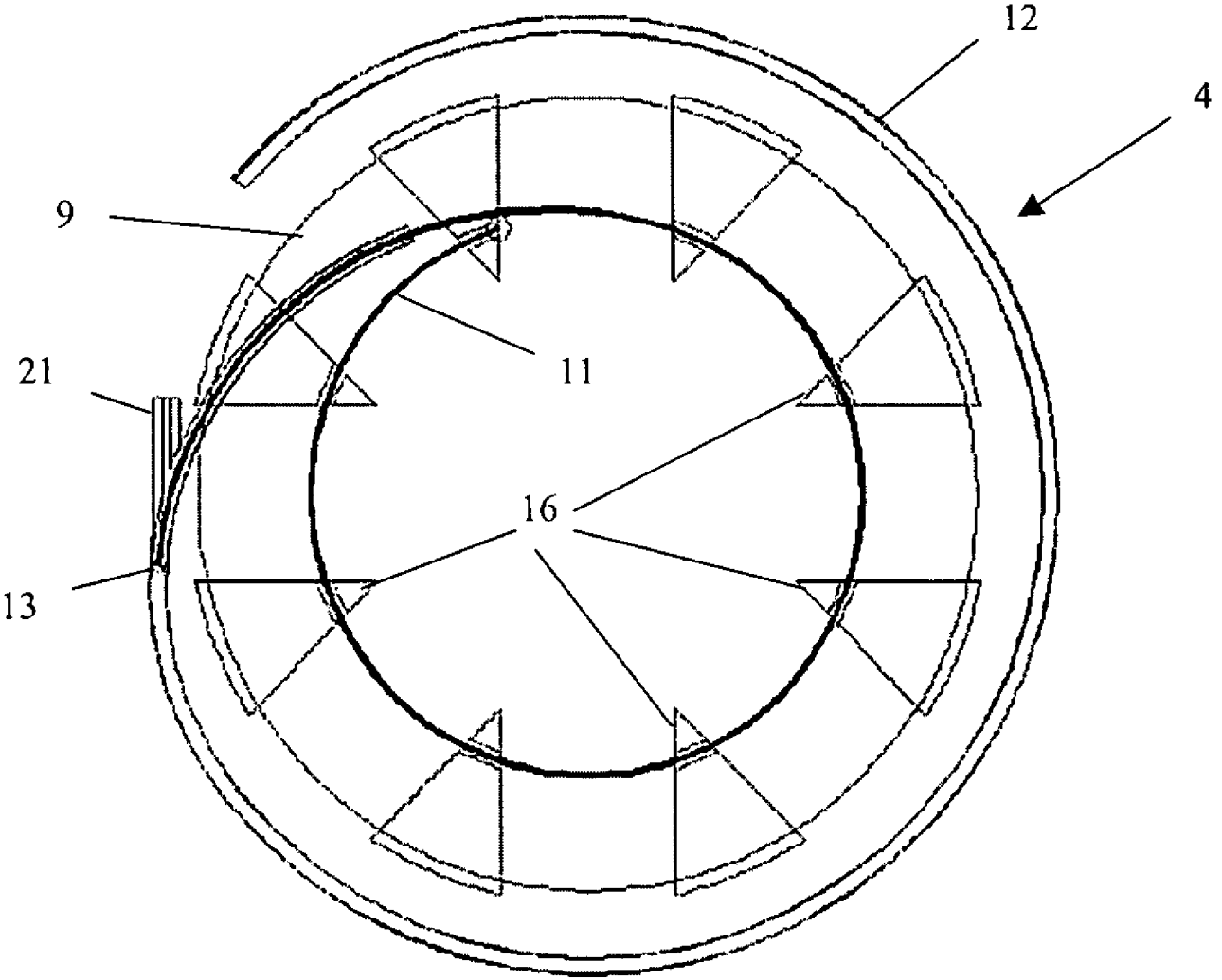
FIG. 4 is a bottom view of the VCV according to FIGS. 1 and 2 illustrating the bottom capture device therefor.

With reference to FIGS. 1 to 3, the VCV generally indicated at 1, includes an inner containment vessel frame 2, a secondary expandable containment vessel layer 3, a bottom capture system 4, and a top lid 5. The inner frame 2 is preferably constructed out of a solid material although a skeletal frame is possible. The inner frame 2 provides an inner mitigation or containment layer, as well as support for the secondary containment layer 3, the bottom capture system 4 and the top lid 5. The inner frame 2 is rectangular or cylindrical, although other shapes are possible, and constructed from materials intended to consume or mitigate blast energy, braced with a tension layer to facilitate the consumption of the blast mitigation material. In its simplest form the inner fame 2 can be made from a heavy cardboard material, 0.5 to 1.5 inches thick, preferably 0.8 to 1.0 inches thick, with a reflective inner layer, e.g. aluminum or mylar. The dimensions of the inner frame 2 can vary for different VCV's, which can be utilized depending on the size of explosive device 6. The secondary expandable containment layer 3 comprises a multi-layer sheet surrounding the inner frame 2 forming a bag 7 and folded, in preferably horizontal layers for storage adjacent to the inner frame 2. Vertically stored layers are also possible, as illustrated in FIG. 3. An upper edge of the bag 7 is attached to the outer edge of the lid 5, whereby an explosion within the inner frame 2, not containable thereby, would cause the lid 5 to separate from the inner frame 2 pulling the bag 7 therewith (see FIG. 2). The inner frame 2 initially redirects the pressure or force of the blast upwardly to the upper lid 5, as illustrated by arrows in FIGS. 1 to 3. Accordingly, the volume of the containment vessel 1 expands along with the explosion, whereby the explosive materials are contained, while the explosive force is vented through vents in the containment vessel 1. Preferably, the bag 7 is pliable, flaccid and/or elastic, and includes flame retardant inner layers, a plurality of heat resistant fabric layers, e.g. Nomex, a plurality of high strength and impact resistant inner layers, e.g. Kevlar or ultra high strength molecular weight polyethylene, and a plurality of high strength outer layers, e.g. fiber glass, polypropylene, nylon, polyester, polyacrylonitrile. Preferably, the top lid 5 is comprised of a composite fabric with high strength, e.g. Kevlar, Aluminum, and heat resistant, e.g. Nomex, layers. The top lid 5 can be equipped with an access port for inserting disruptors and a handle to facilitate manual and robotic manipulation. Preferably, the top lid 5 is 0.25 to 0.5 inches thick, and most preferably 0.375 inches thick, although any suitable thickness is possible. The top lid 5 can be temporarily mounted on the frame 2 via Velcro or other suitable non-permanent or easily frangible fastener.

The bag 7 can be airtight if chemical or biological devices are suspected. For conventional explosives the bag 7 is not air tight, and the more the bag 7 expands the greater the amount of venting, as the surface area increases and as the fabric stretches. Extra ports can be provided, e.g. near where the top lid 5 is connected and where the bottom capture system 4 is mounted. One of the key advantages of the present invention results from an understanding of the chemistry of an explosion. High order explosions result from being under pressure, which typically occurs in conventional bomb disposal containers. However, in the VCV 1 according to the present invention there is little chance for pressure to develop, since the volume expands almost as fast as the explosion, thereby resulting in a low order burn, which has much less potential for destruction.

An outer frame (not shown) can be provided to enclose the bag 7, thereby providing protection during transportation.

Figure 5:
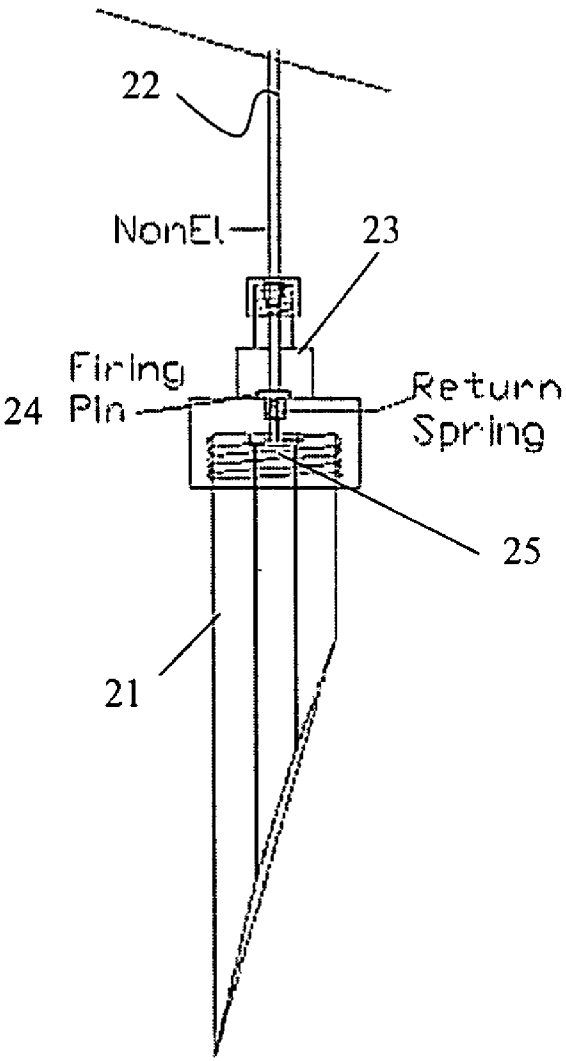
FIG. 5 is a cross sectional view of a remotely actuated trigger for the bottom capture device of FIG. 4.
Figure 6:
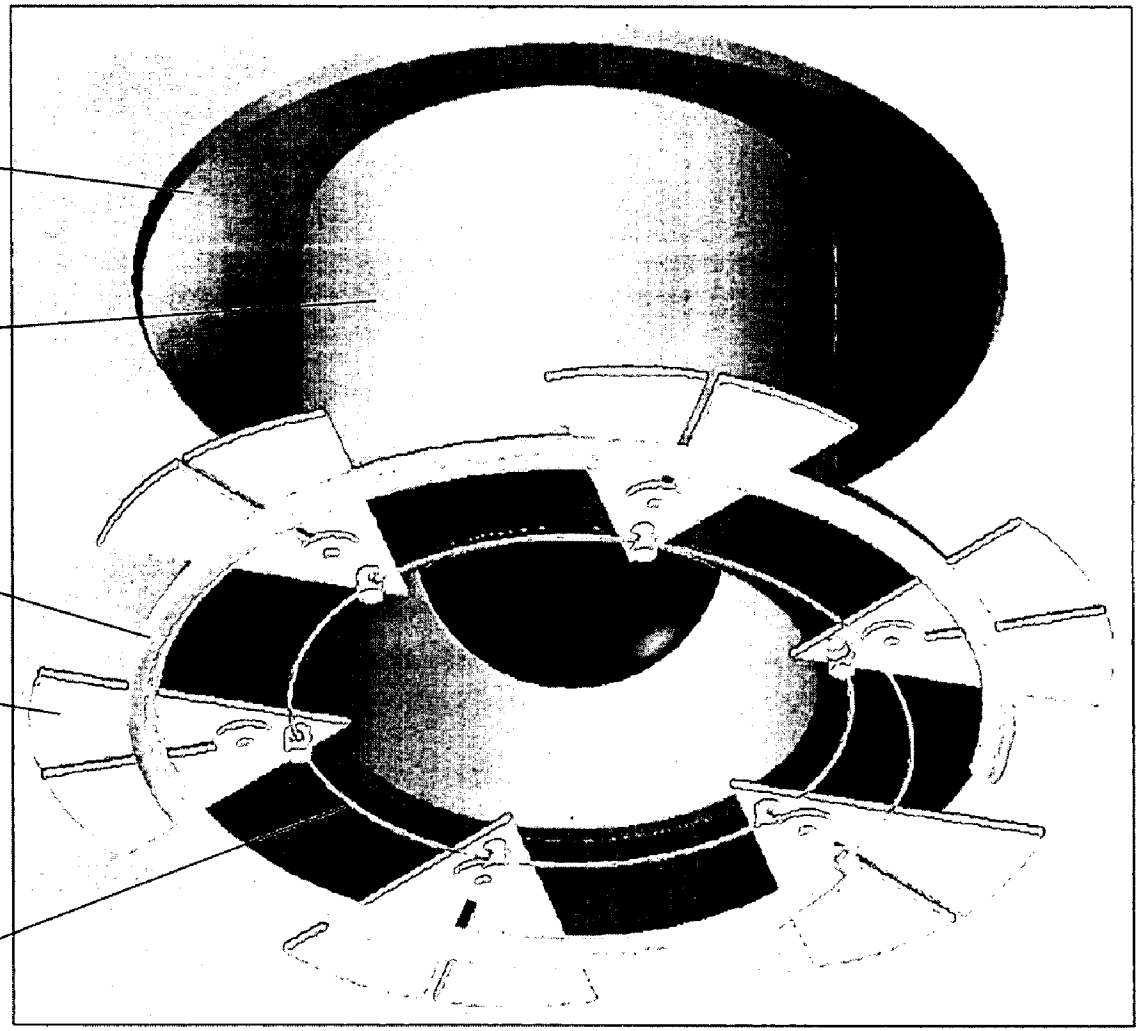
FIG. 6 is an isometric view of VCV of FIGS. 1 and 2 before the bottom capture device has been actuated.
Figure 7:
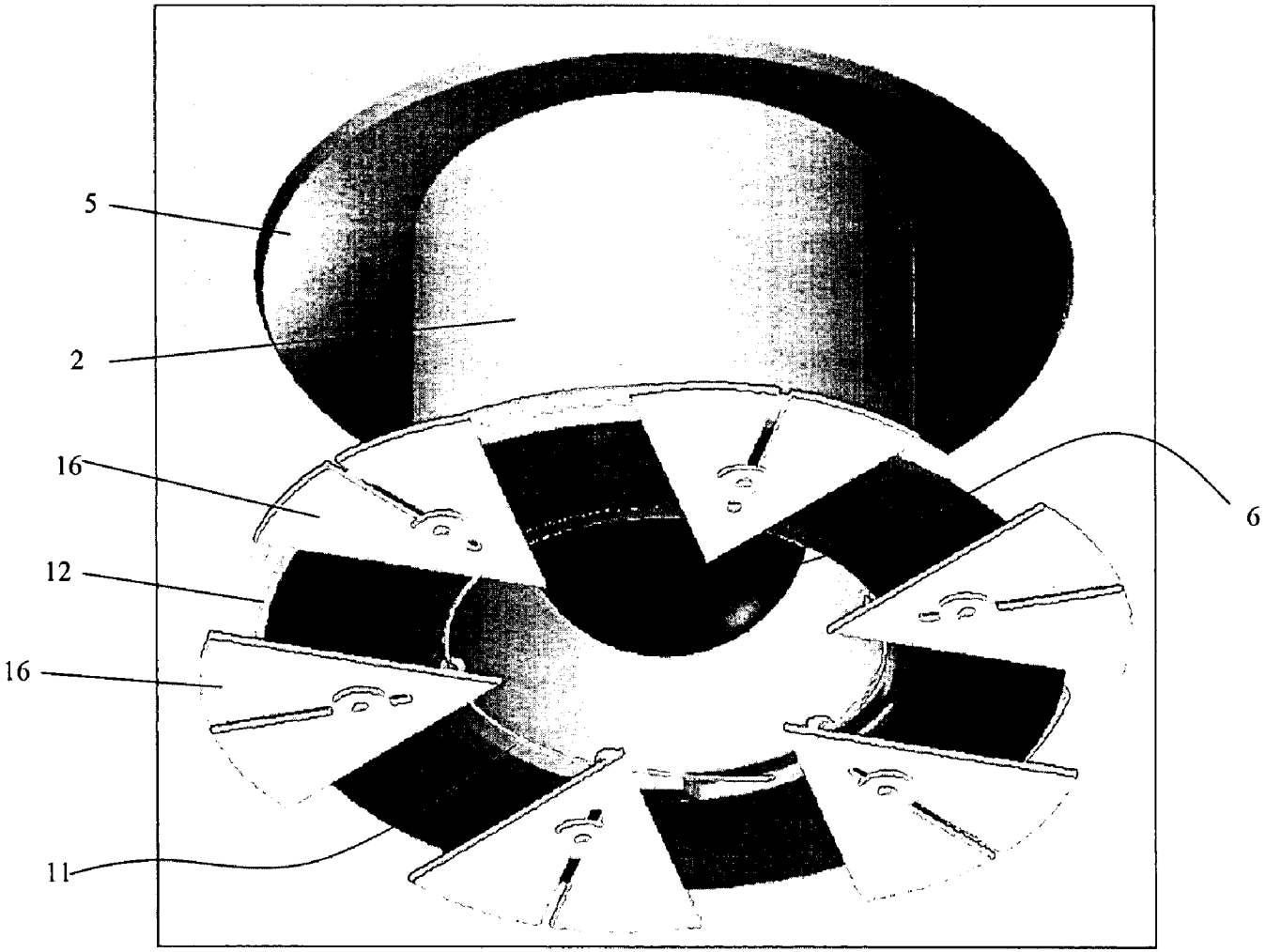
FIG. 7 is an isometric view of the VCV of FIGS. 1 and 2 after the bottom capture device has been actuated.

With reference to FIGS. 4 to 7, the bottom capture system 4 includes a tie cable 11 extending through eyelets formed in the bottom of a flexible sheet material 9, stored near the bottom of the inner frame 2. Preferably, the flexible sheet material 9 is the bottom end of the bag 7. A barrel or raceway 12, encircling the lower edge of the inner frame 2, provides a track for one or more projectiles 13, which are connected to the end(s) of the tie cable 11. When a .32 caliber (or any suitable caliber) blank, similar to a ramset blank, is fired into the raceway 12, the force acts like a propellant and propels the projectile down the raceway 12, which pulls the tie cable 11 and draws the edge of the flexible sheet material 9 together closing and locking the lower portion of the inner frame 2. Other suitable propellants can be used instead of the blank. The blank can be fired manually, e.g. by a robot or EOD technician, from adjacent the VCV 1 or fired remotely using a remotely activated trigger. An example of a remotely activated trigger, illustrated in FIG. 5, is mounted on an extension 21 of the raceway 12, and includes a length of non-electric surface delay detonator 22 (NonEl®). One end of the NonEl 22 is held by an EOD technician remote from the VCV 1, while the other end of the NonEl 22 is fixed proximate the end of the extension 21. Activation of the NonEl 22 causes detonation of a small charge, e.g. blasting cap 23, which accelerates a firing pin 24 into the blank 25 disposed in the extension 21. The force created by the blank 25 propels the projectile 13 down the raceway 12, as hereinbefore described. Other electrical detonation systems are possible including wireless systems, which cause the blank 25 or other propellant to activate.

Once deployed, the cable 11 is locked, i.e. prevented from sliding backwards, by a tapered collet. Wedged pointed fingers 16 can be provided on the edge of the flexible sheet material 9 for sliding under the explosive device 6, ensuring the explosive device is lifted into the inner frame 2 during activation of the capture system 4. The tie cable 11 would also extend through the fingers 16, which would be brought together when the sheet material 9 is drawn together. The fingers 16 are preferably made of a soft plastic, which may or may not break when impacting each other. A plurality of feet extending from the frame 2 lift the frame 2 off the ground enabling the capture system 4 to close unencumbered.

Once the package (bomb) 6 is contained safely within the VCV 1, it is transported to a disposal site, where it can be opened and unloaded.

If need be the Improvised Explosive Device (IED) can be disrupted, e.g. shot, in the bag to disable or detonate the device under safer surroundings. The use of the VCV enables any evidence from the explosive device to be contained within the VCV for future examination. Chemical or biological hazards can also be neutralized in the bag. The VCV 1 can be reused, assuming no structural failure has occurred.

The present invention is built with a frangible frame shape with an open end. To deploy the item one simply sets the VCV 1 over the suspect package and then triggers the capture system 4, which lifts or moves the package into the VCV 1 and gathers the bottom sheet material 9 closed. Once closed, the VCV 1 is locked closed until the cable/plates are destructively released. The frame 2 has a frangible portion, which can be removed using an explosive charge, a thermite device or simply a cutter device positioned to cut the tie cable to release the bottom.

Figure 8:
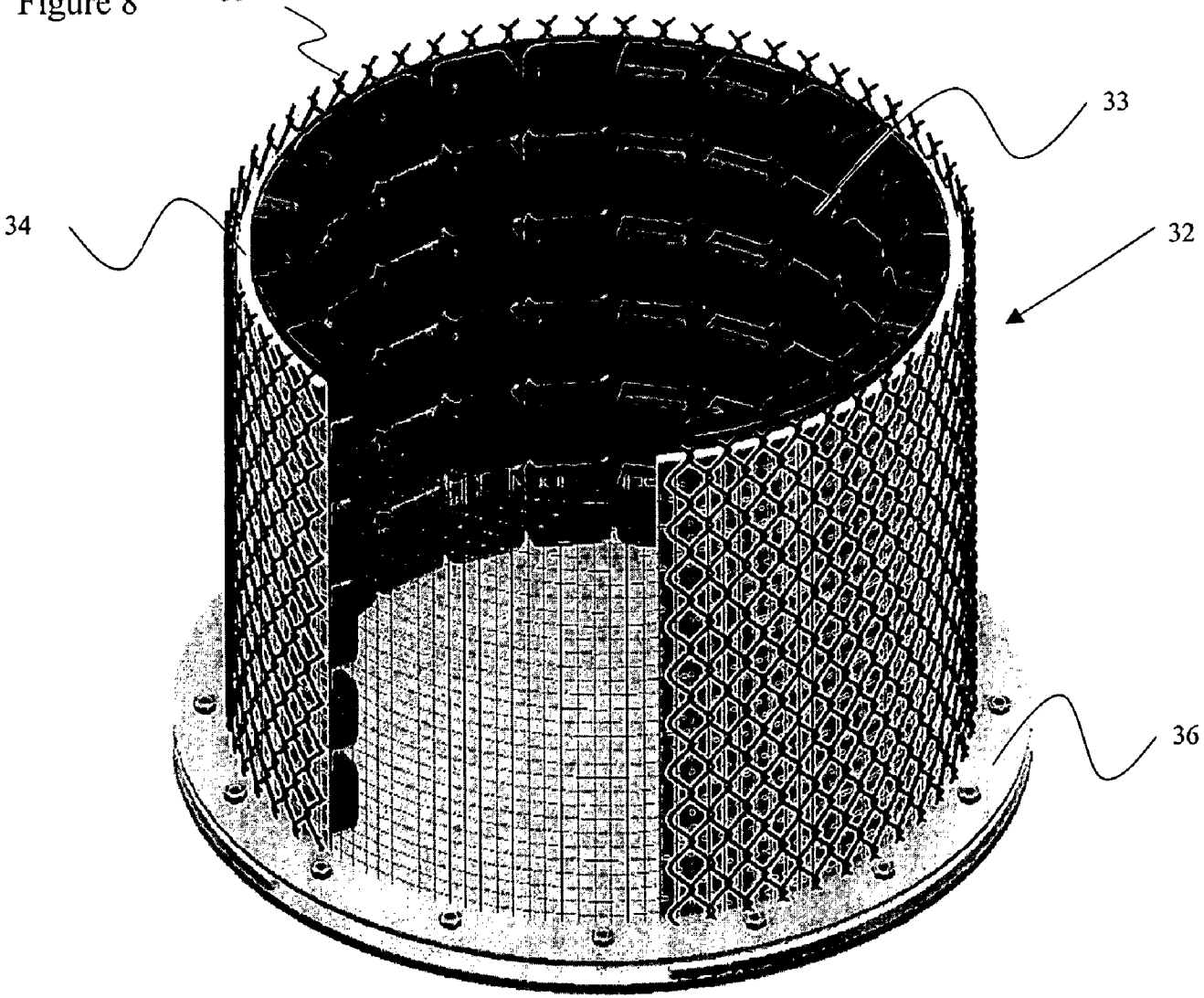
FIG. 8 is a partially sectioned isometric view of an inner mitigating frame in accordance with another embodiment of the present invention.

FIG. 8 illustrates a multi-layer energy-mitigating inner containment vessel frame 32 having an inner shock absorbing layer 33, an intermediate support layer 34, and a outer expandable containment layer 35. The inner shock absorbing layer 33 is comprised of a plurality of square compartments filled with shock-absorbing material, e.g. gel or foam etc. The intermediate support layer 34 can be formed of a strong cardboard or plastic material, but preferably is constructed of a stronger material, such as aluminum. The outer expandable containment layer 35 is comprised of a steel or titanium screen, which is expandable to catch any large projectiles originating from the blast. One end of the inner frame 32 is permanently closed by a cap 36, made of a high strength material, such as aluminum or steel.

Figure 9:
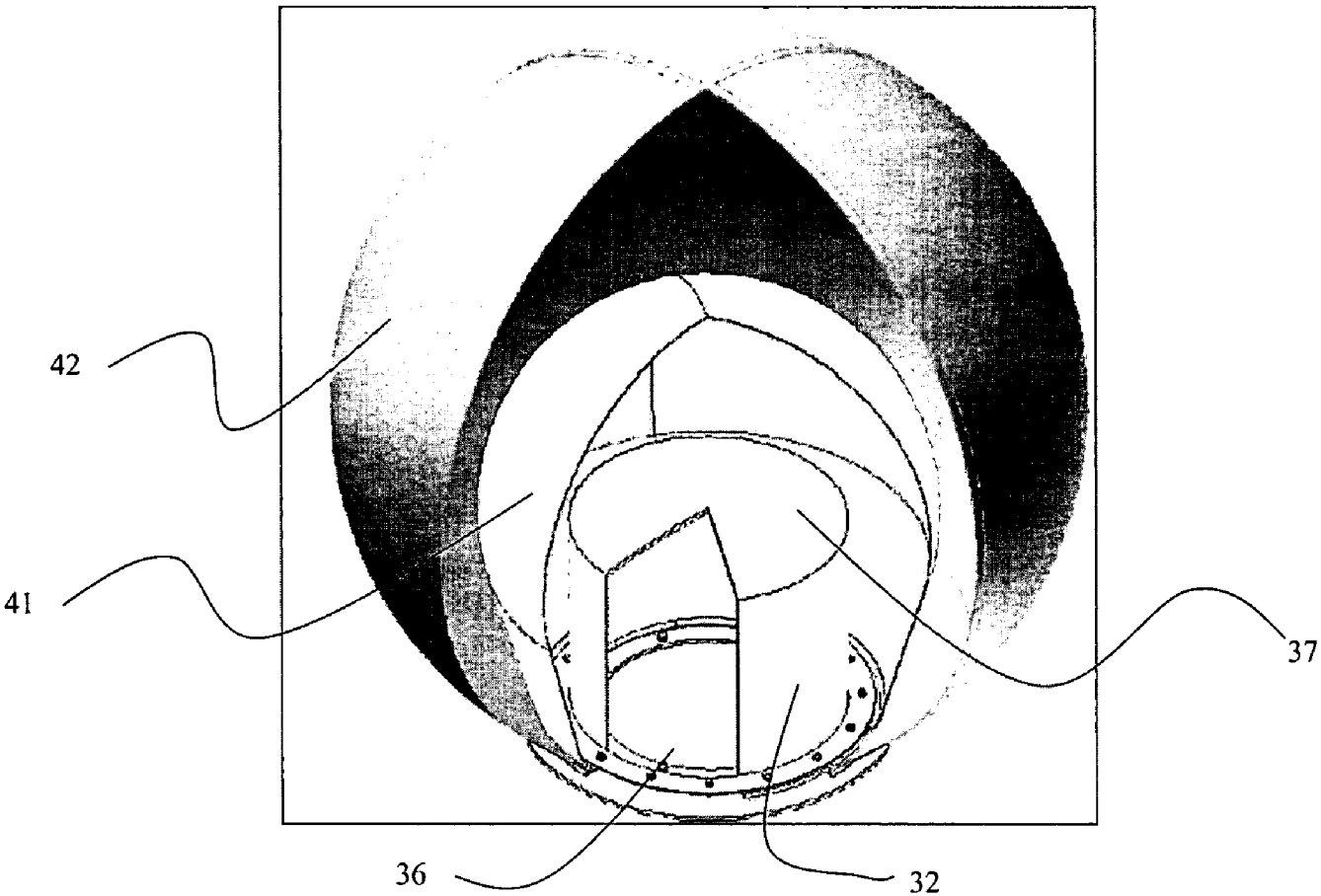
FIG. 9 is a partially sectioned isometric view of a dual outer containment arrangement according to another embodiment of the present invention for a rectangular mitigating frame.

In a "garbage can" configuration, the bottom end of the inner frame 32 is closed by cap 36, and the bomb is placed inside the inner frame 32 manually or using a robot. In the "garbage can" configuration a cover 37 (FIG. 9) is placed over the open top end. The cover 37 can be constructed from a solid high strength metal or from a multi-layer structure similar to the walls of the inner frame 32, i.e. shock-absorbing material 33, intermediate support layer 34 and outer containment layer 35. In addition, a secondary expandable containment structure 38 can be placed over the inner frame 32. In the embodiment illustrated in FIG. 9, the secondary expandable containment structure or vessel is comprised of a pair a multi-layer sheets surrounding the inner frame 32 forming an inner and outer bags 41 and 42. As above, the bags 41 and 42 are pliable, flaccid and/or elastic, and includes flame retardant inner layers, a plurality of heat resistant fabric layers, e.g. Nomex, a plurality of high strength and impact resistant inner layers, e.g. Kevlar or ultra high strength molecular weight polyethylene, and a plurality of high strength outer layers, e.g. fiber glass, polypropylene, nylon, polyester, polyacrylonitrile. The inner bag 41 can be vented into the outer bag 42 ensuring that the outer bag 42 expands with the inner bag 41. The outer bag 42 can be air tight to contain chemical or biological agents or vented to the atmosphere. For conventional explosives the outer bag 42 is not air tight, and the more the outer bag 42 expands the greater the amount of venting, as the surface area increases and as the fabric stretches.

Figure 10:
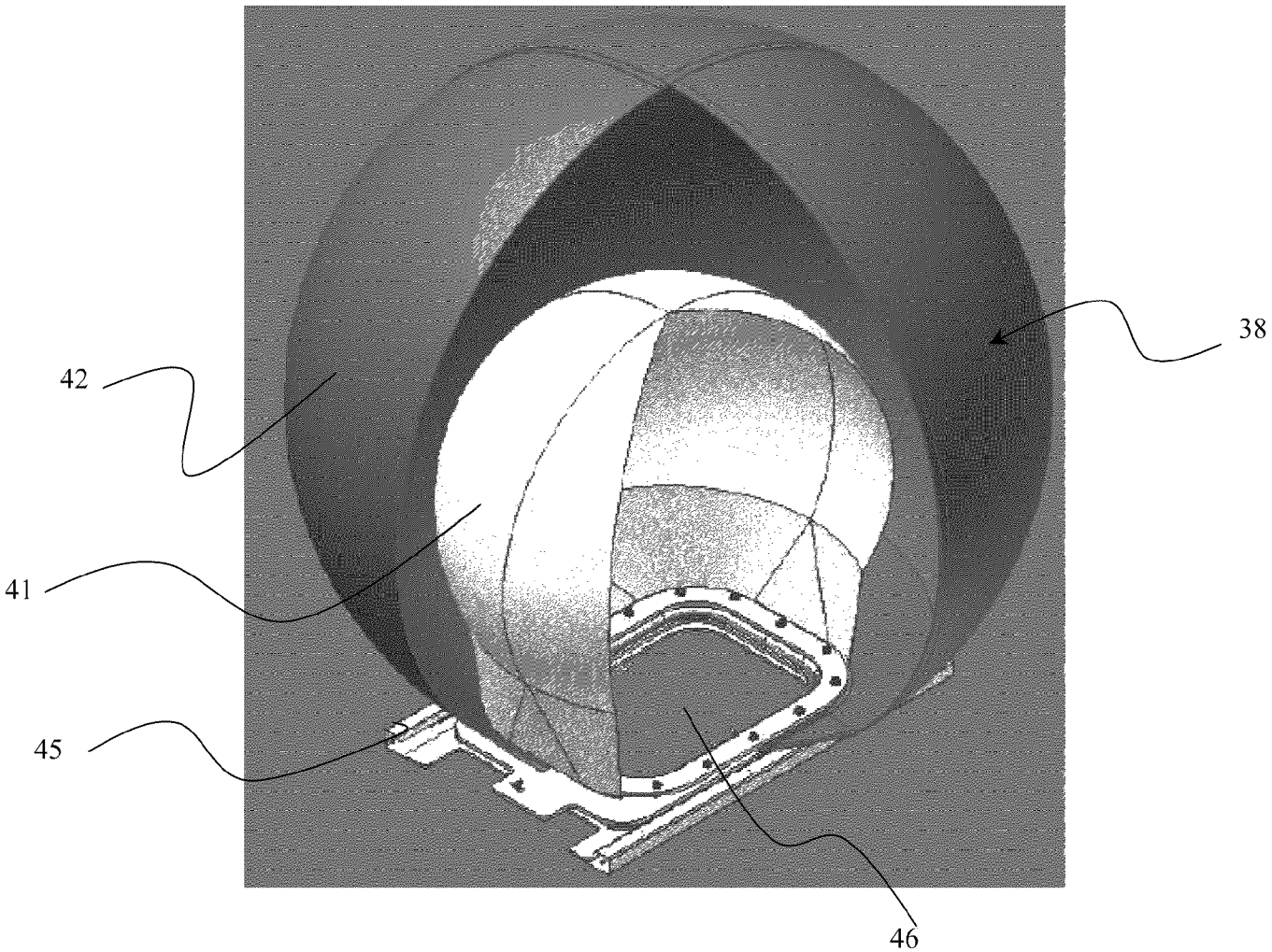
FIG. 10 is a partially sectioned isometric view of the dual outer containment arrangement of FIG. 9 with a cylindrical mitigating frame.

In an alternative "bottom loading" embodiment, illustrated in FIG. 10, the cap 36 is on the top of the inner frame 32, and the bottom of the inner frame 32 includes a door closing apparatus 45, described in greater detail below with reference to FIGS. 11 and 12. The "bottom loading" configuration can include the single layer expandable containment structure, e.g. bag 7, disclosed above with reference to FIGS. 1 to 3 or the multi-layer arrangement including inner and outer bags 41 and 42, see FIG. 10. The inner frame 32 can also have a rectangular shape or a rectangular opening corresponding to a rectangular opening 46 in the door closing apparatus 45, which is better suited to fit over rectangular explosive devices, e.g. briefcases etc.

Figure 11:
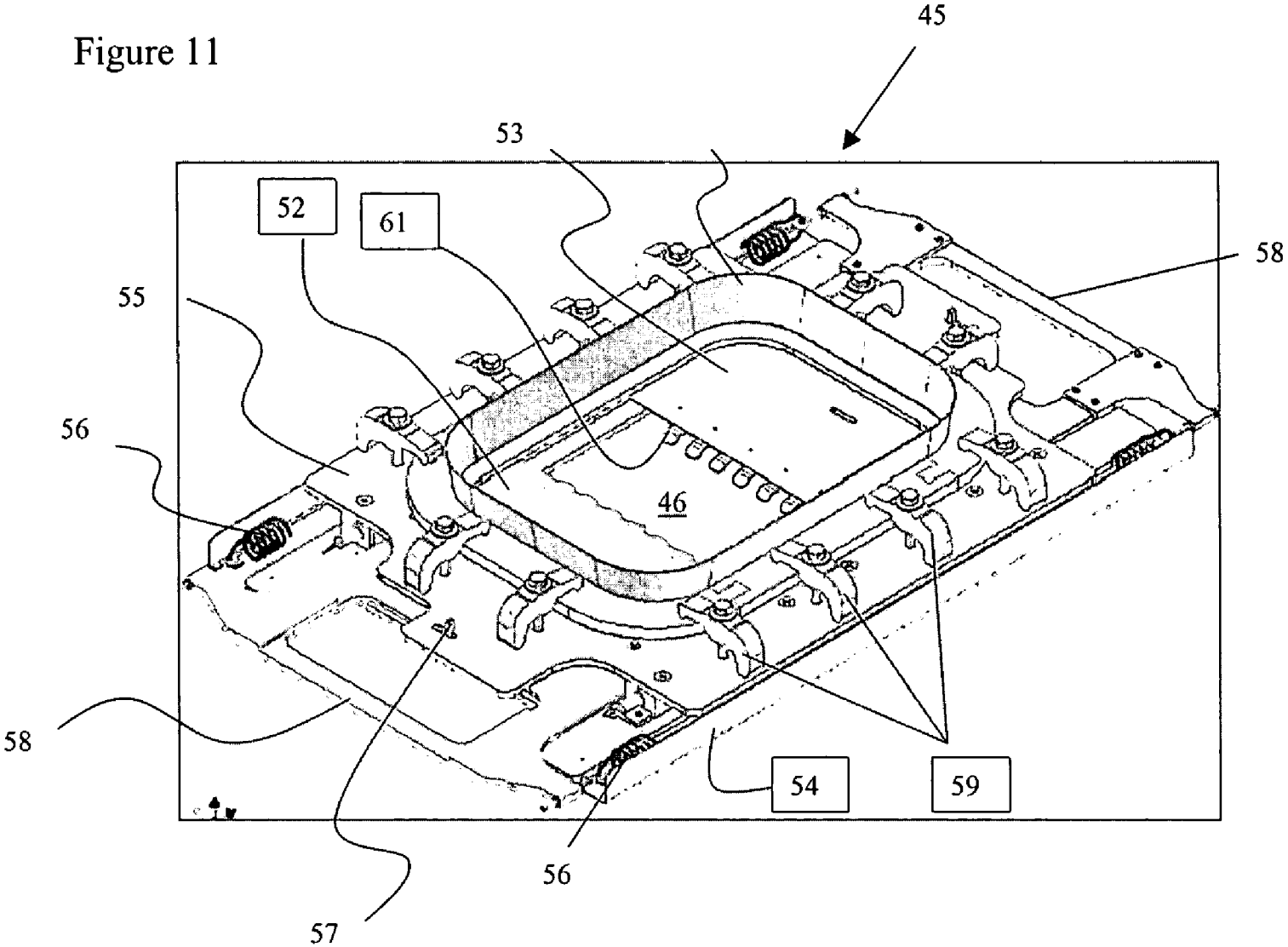
FIG. 11 is an isometric view of a door closing device according to an embodiment of the present invention in an open position.
Figure 12:
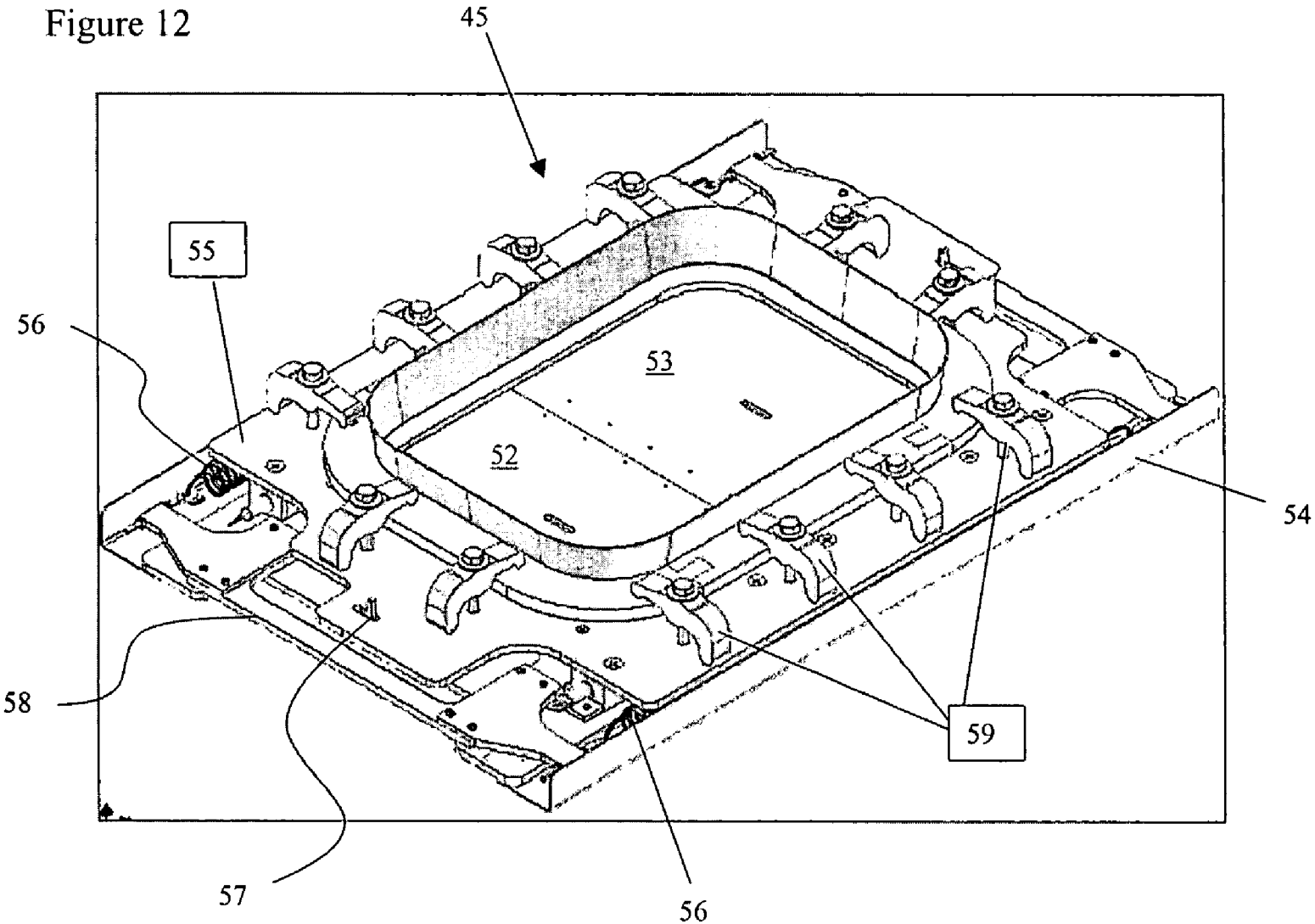
FIG. 12 is an isometric view of the door closing device of FIG. 11 in the closed position.

The door closing apparatus 45, which provides the function of a bomb capture device, is illustrated in FIGS. 11 and 12, and includes a base 51 with reciprocating jaws 52 and 53 slideable therein. The base 51 includes upper and lower structures 54 and 55 with the jaws 52 and 53 slideable therebetween. The jaws 52 and 53 are spring loaded with springs 56 and locked in an open position with a latch 57, which is released upon actuation, i.e. remote or robotic. Alternatively, the jaws 52 and 53 could be propelled from a rest position using some form of propellant for closing the jaws 52 and 53 in under 1 second, preferably under 0.5 of a second, more preferably in under 0.25 of a second, and most preferably in under 0.1 of a second. A handle 58 is provided on each jaw 52 and 53 for manually opening and setting the jaws 52 and 53. A plurality of threaded fasteners 59 with L-shaped clamps surround the opening 46 for holding the inner frame 32 onto the base 51.

A plurality of teeth 61 extend outwardly and downwardly from the leading edge of both of the jaws 52 and 53 into close proximate with the ground under the base 51, whereby when the jaws 52 and 53 are actuated, the teeth 61 with engage the bottom of the bomb and lift it up into the inner frame 32, thereby capturing the bomb within the containment structure. The teeth 61 extend below the jaws 52 and 53, so as not to interfere with the tight closure of jaws 52 and 53, as seen in FIG. 12.

Figure 13:
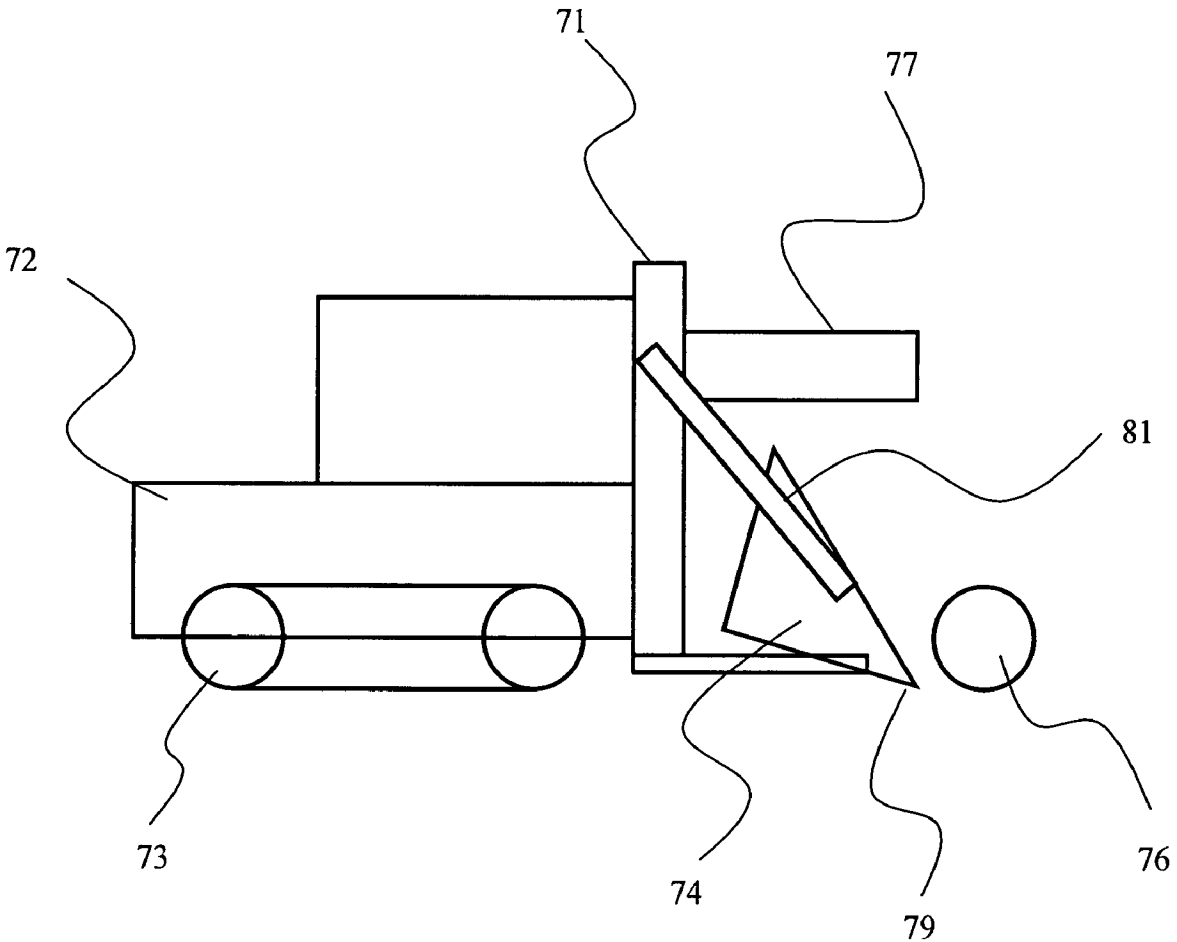
FIG. 13 is a sketch of a robot deployed embodiment of the VCV according to the present invention.
Figure 14:
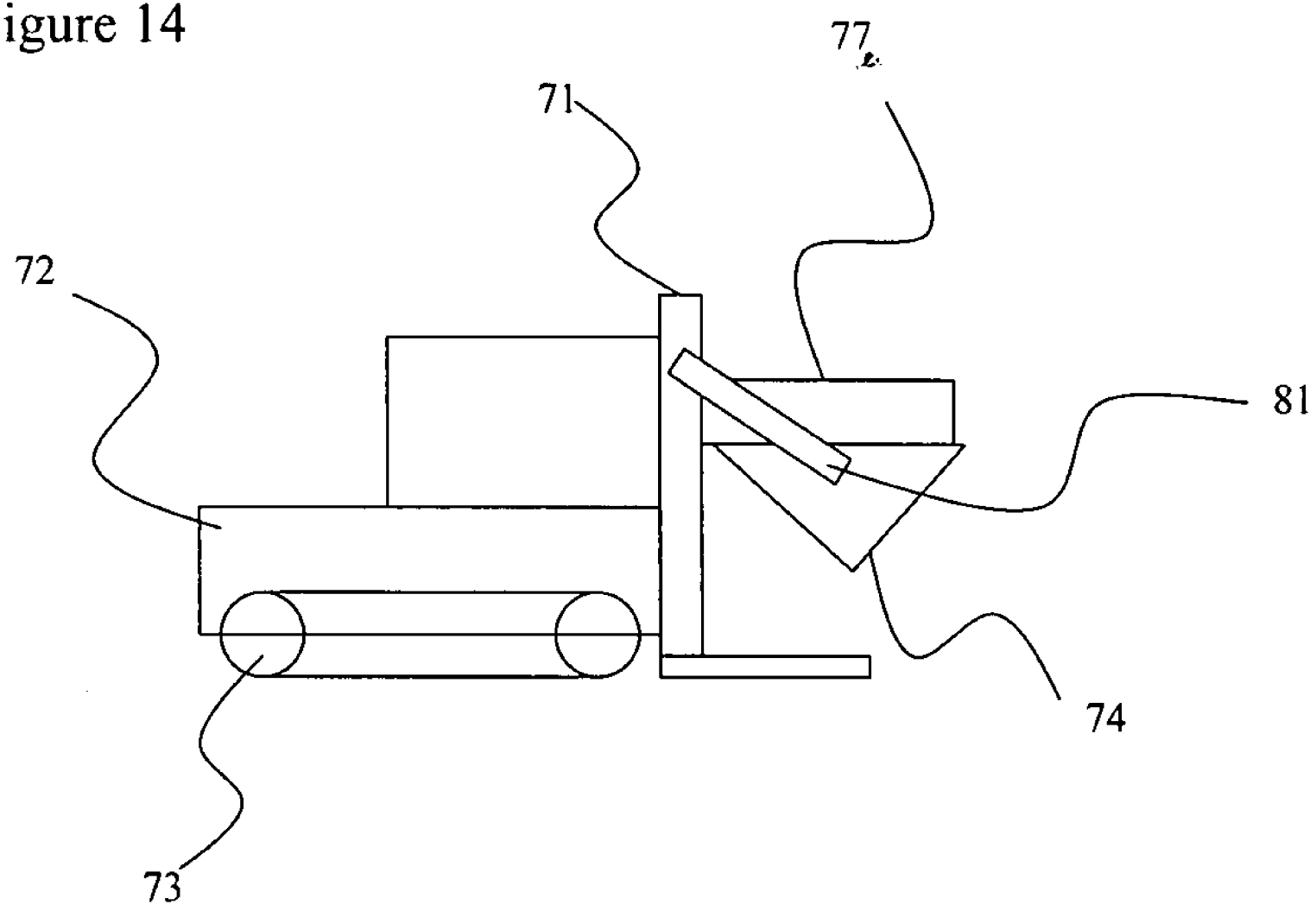
FIG. 14 is a sketch of the robot deployed embodiment of the VCV according to the present invention according to FIG. 13.

A robot mounted embodiment of the present invention, illustrated in FIGS. 13 and 14, includes a supporting mount 71 fixed on the front of a robot 72 with ground engaging tracks 73 for supporting an inner containment vessel frame 74 with an opening in a sidewall thereof. The inner containment vessel 74 is pivotable in relation to the supporting mount 71 from an open or shovel position illustrated in FIG. 13 and a closed position illustrated in FIG. 14. In use, the robot 72 is directed to position the inner containment vessel 74 adjacent to the potential explosive device 76. Teeth or a tapered lip 79 can be provided at the leading edge of the inner containment vessel 74 for extending under the explosive device 76 enabling the explosive device 76 to be lifted into the inner containment vessel 74. Typically the explosive device 76 will be placed up against a wall or other structure, whereby movement of the robot 72 towards the wall or other structure will force the leading edge of the inner containment vessel 74 under the explosive device 76 and cause the explosive device 76 to slide into the inner containment vessel 74. After the explosive device 76 has entered the inner containment vessel 74, the inner containment vessel 74 is rotated by piston arm 81 or some other mechanical device to the closed position (FIG. 14) with the outer containment vessel 77 covering the opening therein. Preferably, the inner containment vessel 74 is a multi-layer construction, similar to the energy-mitigating inner containment vessel frame 32. The robot configuration can include the single layer expandable outer containment structure 77 mounted on a top end of the inner containment vessel, e.g. bag 7, disclosed above with reference to FIGS. 1 to 3 or the multi-layer arrangement including inner and outer bags 41 and 42, as in FIG. 10 for secondary dissipation of energy and the containment of explosive material.

A smaller version of the robot mounted embodiment of FIGS. 13 and 14 can be mounted on the end of a handle rather than a robot for picking up and enclosing smaller potentially explosive packages, which may be positioned in enclosed areas.

The present invention will modify current modern day RSPs by providing an explosion containment device that whenever possible should be use to contain a suspicious package, even before it is X-rayed. Moreover, a VCV, according to the present invention should be used first to mitigate damage to local property or bomb team personnel and elements, such as robots.

We claim:

1. An explosion containment device for enclosing an explosive device comprising:

a frame having a closed end, and an initially open lower end for placing the frame over the explosive device;

an outer containment vessel having an expandable volume, the outer containment vessel mounted on and surrounding the frame, and having an opening for placing over the explosive device to enclose the explosive device within the frame and the outer containment vessel; and an actuatable door for closing the open end of the frame and for engaging the explosive device to capture the explosive device within the frame and the outer containment vessel, the actuatable door including first and second reciprocating jaws in the open end of the frame; wherein the first and second jaws comprise leading edges that make contact when the first and second jaws are in a closed position, and a plurality of teeth that extend outwardly and downwardly from the leading edges thereof, whereby actuation of the first and second jaws cause the teeth to engage the explosive device and lift the explosive device into the frame; and whereby detonation of the explosive device causes the outer containment vessel to expand, thereby containing the explosion and preventing failure thereof.

2. The explosion containment device according to claim 1, wherein the frame comprises a structurally solid inner containment vessel for directing the explosion upwardly.

3. The explosion containment device according to claim 2, wherein the top end of the frame is closed with a lid; and wherein the outer containment vessel is comprised of a multi-layer sheet of material with an edge thereof attached around the frame, whereby detonation of the explosive device raises the lid causing the outer containment vessel to expand.

4. The explosion containment device according to claim 3, wherein the multi-layer sheet of material comprises one or more layers selected from the group consisting of high strength and impact resistant layers, heat resistant fabric layers, and Glass fiber.

5. The explosion containment device according to claim 3, wherein the multi-layer sheet is folded around the outside of the frame.

6. The explosion containment device according to claim 5, wherein the multi-layer sheet is folded into a series of horizontal layers surrounding the frame.

7. The explosion containment device according to claim 1, wherein the actuatable door is actuatable remotely.

8. The explosion containment device according to claim 1, wherein each of the first and second jaws is spring loaded and capable of being held in an open position forming the opening in the lower end of the frame.

9. The explosion containment device according to claim 1, wherein the outer containment vessel is comprised of a multi-layer sheet of material with an edge thereof attached around the frame, whereby detonation of the explosive device causes the outer containment vessel to expand.

10. The explosion containment device according to claim 9, wherein the multi-layer sheet of material comprises one or more layers selected from the group consisting of high strength and impact resistant layers, heat resistant fabric layers, and Glass fiber.

11. The explosion containment device according to claim 9, wherein the multi-layer sheet is folded around the outside of the frame.

12. The explosion containment device according to claim 9, wherein the multi-layer sheet is folded into a series of horizontal layers surrounding the frame.

* * * * *